US005565421A

United States Patent [19]

Aszman et al.

[11] Patent Number: 5,565,421

[45] Date of Patent: Oct. 15, 1996

[54] GELLED LIGHT DUTY LIQUID DETERGENT CONTAINING ANIONIC SURFACTANTS AND HYDROXYPROPYL METHYL CELLULOSE POLYMER

[75] Inventors: Harry Aszman, Englishtown; Gilbert Gomes, Somerset; Chung Lee, Edison, all of N.J.

[73] Assignee: Colgate Palmolive Co., Piscataway, N.J.

[21] Appl. No.: 378,898

[22] Filed: Jan. 26, 1995

Related U.S. Application Data

[63] Continuation-in-part of Ser. No. 153,522, Nov. 16, 1993, abandoned.

[51] Int. Cl.[6] ..... C11D 1/84; C11D 1/14

[52] U.S. Cl. ..... 510/403; 510/426; 510/428; 510/429; 510/471

[58] Field of Search ..... 252/549, 550, 252/551, 552, 173.14, DIG. 16, 174.17

[56] References Cited

U.S. PATENT DOCUMENTS

| | | | |
|---|---|---|---|
| 4,446,032 | 5/1984 | Munteanu et al. | 252/8.6 |
| 4,464,271 | 8/1984 | Munteanu et al. | 252/8.6 |
| 4,554,098 | 11/1985 | Klish et al. | 252/547 |

*Primary Examiner*—Paul Lieberman
*Assistant Examiner*—Necholus Ogden
*Attorney, Agent, or Firm*—Richard Enanfeldt; James Serafino

[57] ABSTRACT

A gelled, light duty, detergent with desirable cleansing properties and mildness to the human skin comprising an alkyl sulfate or sulfonate anionic surfactant, an ethoxylated alkyl ether sulfate, a hydroxypropyl methyl cellulose polymer, a magnesium containing compound and water.

3 Claims, No Drawings

GELLED LIGHT DUTY LIQUID DETERGENT CONTAINING ANIONIC SURFACTANTS AND HYDROXYPROPYL METHYL CELLULOSE POLYMER

RELATED APPLICATION

This application is a continuation in part application of U.S. Ser. No. 8/153,522 filed Nov. 16, 1993 now abandoned.

FIELD OF THE INVENTION

The present invention relates to a gelled detergent composition having a gelling system comprising a hydroxypropyl methyl cellulose polymer and a magnesium containing compound.

BACKGROUND OF THE INVENTION

The present invention relates to novel light duty detergent compositions with high foaming properties, containing a sulfate or sulfonate anionic surfactant, optionally a nonionic surfactant and/or a zwitterionic surfactant, magnesium sulfate heptahydrate and the balance being water wherein the surfactants are dissolved in an aqueous medium and the composition is thickened with a hydroxypropyl methyl cellulose polymer in combination with a magnesium containing compound.

The prior art is replete with light duty liquid detergent compositions containing nonionic surfactants in combination with anionic and/or betaine surfactants wherein the nonionic detergent is not the major active surfactant. For example, in U.S. Pat. No. 3,658,985 the anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient. Furthermore, this patent finds heavily foaming detergents undesirable for the purpose of washing socks.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylene polyoxyethylene nonionic detergent, an anionic surfactant, a fatty acid alkanolamide and a polyoxyalkylene glycol fatty ester.

U.S. Pat. No. 4,595,526 describes a composition comprising a nonionic surfactant, a betaine surfactant, an anionic surfactant and a $C_{12}$–$C_{14}$ fatty acid monethanolamide foam stabilizer.

However, none of the above-cited patents discloses a gelled light duty detergent composition containing a sulfate or sulfonate anionic surfactant, a hydroxypropyl methyl cellulose polymer, a sulfonate hydrotrope, optionally a nonionic surfactant and/or a zwitterionic surfactant selected from betaine type surfactants, a magnesium containing compound such as magnesium sulfate heptahydrate and the balance being water.

SUMMARY OF THE INVENTION

The present invention relates to a gelled light duty detergent composition which comprises a sulfate or sulfonate anionic surfactant, a metal salt of an ethoxylated alkyl ether sulfate surfactant, optionally, a nonionic surfactant and/or a zwitterionic betaine surfactant, magnesium sulfate heptahydrate, a hydroxypropyl methyl cellulose polymer and the balance being water, wherein the composition does not contain any amine oxide, urea, clay, silica, clay thickeners or more than 3 wt. % of a fatty acid or its metal salt.

Still another object of this invention is to provide a gelled light duty detergent composition with desirable high foaming and cleaning properties which is mild to the human skin.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein the novel, high foaming, gelled, light duty detergent composition of this invention comprises active anionic surfactants which are a mixture of a metal salt ethoxylated alkyl ether sulfate and an alkali salt of an alkyl sulfate or sulfonate surfactant, optionally, a nonionic surfactant and/or a zwitterionic surfactant selected from the class of betaines, magnesium sulfate heptahydrate, hydroxypropyl methyl cellulose polymer and water.

The total amount of surfactants may constitute about 5.0%–50%, preferably about 15%–45%, most preferably 25%–35%, by weight of the gelled composition.

DETAILED DESCRIPTION OF THE INVENTION

The instant gelled light duty detergent compositions comprise approximately by weight:

(a) 15% to 30% of an ammonium or alkali metal salt of an alkyl sulfate or sulfonate anionic surfactant;

(b) 1% to 6% of a metal salt of a $C_8$–$C_{18}$ ethoxylated alkyl ether sulfate;

(c) 0 to 20% of a nonionic surfactant;

(d) 0 to 10% of a zwitterionic surfactant;

(e) 0 to 7% of an alkali metal hydroxide;

(f) 0 to 8% of an alkali metal salt of an aryl sulfonate hydrotrope;

(g) a gelling system comprising 2 to 10% of a magnesium containing salt and 0.5 to 6% of a hydroxypropyl methyl cellulose polymer; and (h ) the balance being water, wherein the gelled composition has a viscosity at 25° C. of about 100,000 to about 1,000,000 cps, more preferably about 150,000 to about 300,000 cps, measured using a Brookfield viscometer with spindle E at 10 RPMs and the gelled composition is optically and crystal clear with a light transmission of at least about 90%, more preferably at least about 95%. The gelled detergent compositions are thermally stable up to a melt temperature of about 80° C., more preferably about 90° C.

A mixture of two anionic surfactant are utilized in the composition. The mixture comprises about 15 to 30 wt.%, more preferably 16 to 26 wt. % of an alkali metal or ammonium salt of an alkyl sulfate or sulfonate anionic surfactant and 1 to 6 wt. %, more preferably 1.5 to 5 wt. % of a metal salt of a $C_8$–$C_{18}$ ethoxylated alkyl ether sulfate, wherein the weight ratio of the sulfonate surfactant to the ethoxylated alkyl ether sulfate surfactant in the composition is about 30:1 to 2:1, more preferably 25:1 to 3:1.

The alkyl anionic sulfate and sulfonate surfactants which may be used in the detergent of this invention are water soluble such as triethanolamine and include the sodium, potassium, ammonium and ethanolammonium salts of $C_8$–$C_{18}$ alkyl sulfates such as lauryl sulfate, myristyl sulfate and the like; linear $C_8$–$C_{16}$ alkyl benzene sulfonates; $C_{10}$–$C_{20}$ paraffin sulfonates and alpha olefin sulfonates containing about 10–24 carbon atoms. The preferred sulfate surfactant is a $C_8$ to $C_{14}$ sulfate.

The paraffin sulfonates may be monosulfonates or disulfonates and usually are mixtures thereof, obtained by sulfonating paraffins of 10 to 20 carbon atoms. Preferred paraffin sulfonates are those of $C_{10-14}$ carbon atoms chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{10-14}$ range will be minor and will be minimized, as will be any contents of di- or poly-sulfonates.

Examples of other suitable sulfonated anionic detergents are the well known higher alkyl mononuclear aromatic sulfonates, such as the higher alkyl benzene sulfonates containing 9 to 18 or preferably 9 to 10 to 15 or 16 carbon atoms in the higher alkyl group in a straight or branched chain, or $C_{8-15}$ alkyl toluene sulfonates. A preferred alkyl benzene sulfonate is a linear alkyl benzene sulfonate having a higher content of 3-phenyl (or higher)isomers and a correspondingly lower content (well below 50%) of 2-phenyl (or lower)isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The ethoxylated alkyl ether sulfate (AEOS.xEO)is depicted by the formula: R-$(OCHCHC_2)$x $OSO_3M$ wherein x is about 1 to 10, more preferably about 1 to about 5, more preferably about 1 to about 4 and R is an alkyl group having about 8 to 18 carbon atoms and more preferably about 12 to about 15 carbon atoms and natural cuts for example $C_{12-14}$, $C_{12}$–$C_{13}$ and $C_{12-15}$ and M is an alkali metal cation such as sodium or potassium or an alkali earth metal cation such as magnesium. Examples of satisfactory anionic ethoxylated sulfate are the $C_{8-18}$ ethoxylated alkyl ether sulfate salts having the formula: R'$(OCH_2$–$H_4)$n $OSO_3M$ wherein R' is alkyl of 8 or 9 to 18 carbon atoms, n is 0 to 22, preferably 0 to 5, and M is a sodium cation. The ethoxylated alkyl ether sulfates may be made by sulfating the condensation product of ethylene oxide and $C_{8-18}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether sulfates contain 10 to 6 carbon atoms in the alcohols and in the alkyl groups thereof.

Ethoxylated $C_{8-18}$ alkyl phenyl ether sulfates containing from 2 to 6 moles of ethylene oxide in the molecule also are suitable for use in the inventive microemulsion compositions. These detergents can be prepared by reacting an alkyl phenol with 2 to 6 moles of ethylene oxide and sulfating and neutralizing the resultant ethoxylated alkyl phenol 5 to 20%, and more preferably 10 to 16%, e.g., 13%, and the resulting microemulsion, which will also contain free hydroxyl ions, will be of a pH of at least 12, preferably at least 13, such as in the ranges of 12 to 14 and 13 to 14, e.g. 13.5 or about 14.

The nonionic surfactant which can be contained in the gelled detergent composition is present in amounts of about 0% to 20 wt. %, preferably 1% to 10 wt. %, by weight of the composition and provides superior performance in the removal of oily soil and mildness to human skin.

The water soluble nonionic surfactants utilized in this invention are commercially well known and include the primary aliphatic alcohol ethoxylates, secondary aliphatic alcohol ethoxylates, alkyl phenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohols containing about 9–15 carbon atoms, such as $C_9$–$C_{11}$ alkanol condensed with 8 moles of ethylene oxide (Neodol 91–8), $C_{12-13}$ alkanol condensed with 6.5 moles ethylene oxide (Neodol 23–6.5), $C_{12-15}$ alkanol condensed with 12 moles ethylene oxide (Neodol 25–12), $C_{14-15}$ alkanol condensed with 13 moles ethylene oxide (Neodol 45–13), and the like. Such ethoxamers have an HLB (hydrophobic lipophilic balance) value of about 8 to 15 and give good O/W emulsification, whereas ethoxamers with HLB values below 8 contain less than 5 ethylene oxide groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl phenol condensed with about 9.5 moles of EO per mole of nonyl phenol, dinonyl phenol condensed with about 12 moles of EO per mole of dinonyl phenol, dinonyl phenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Condensates of 2 to 30 moles of ethylene oxide with sorbitan mono- and tri-$C_{10}$–$C_{20}$ alkanoic acid esters having a HLB of 8 to 15 also may be employed as the nonionic detergent ingredient in the described composition. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

The composition can contain about 0 to 5 wt. %, more preferably 0.5 to 4.5 wt. % of an alkali metal hydroxide such as sodium hydroxide or potassium hydroxide, wherein the alkali metal hydroxide is present in sufficient concentration to adjust the pH of the composition to about 5.5 to about 7.0, more preferably about 6.2 to about 6.8.

The composition can contain about 0 to about 8 wt. %, more preferably about 1 wt. % to about 6 wt.% a hydrotrope such as a sodium salt of benzene sulfonate, xylene sulfonate or cumene sulfonate.

The gelled compositions of the instant invention contain a gelling system which is a magnesium containing compound such as magnesium sulfate heptahydrate at a concentration of about 2 to about 10 wt. %, more preferably about 2.5 wt. % to about 8 wt. % and a hydroxypropyl methyl cellulose polymer at concentration of about 1 wt. % to about 6 wt. %, more preferably about 1.5 wt. % to about 5 wt. %, wherein the hydroxypropyl cellulose polymer has a number average molecular weight of about 50,000 to 125,000 and a viscosity of a 2 wt. % aqueous solution at 25° C. (ADTM D2363) of about 50,000 to about 100,000 cps. An especially preferred hydroxypropyl cellulose polymer is Methocel™ J75MS-N manufactured by Dow Chemical Company, wherein a 2.0 wt. % aqueous solution at 25° C. has a viscosity of about 75,000 cps. Especially preferred hydroxypropyl cellulose polymers are surface treated such that the hydroxypropyl cellulose polymer will ready disperse at 25° C. into an aqueous solution having a pH of at least about 8.5.

The water-soluble zwitterionic surfactant, which can be contained in the present liquid detergent composition, constitutes about 0 to 10%, preferably 1% to 9%, by weight and provides good foaming properties and mildness to the present nonionic based liquid detergent. The zwitterionic surfactant is a water soluble betaine having the general formula:

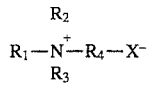

wherein $X^-$ is selected from the group consisting of $SO_3^-$ and $CO_2^-$ and $R_1$ is an alkyl group having 10 to about 20 carbon atoms, preferably 12 to 16 carbon atoms, or the amido radical:

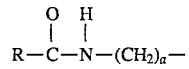

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine.

The ingredients discussed above except for the hydroxypropyl cellulose polymer are solubilized in an aqueous medium comprising water and optionally, solubilizing ingredients such as alcohols and dihydroxy alcohols such as ethanol isopropanol and propylene glycol. Suitable water soluble hydrotropic salts include sodium, potassium, ammonium and mono-, di- and triethanolammonium salts. While the aqueous medium is primarily water, preferably said solubilizing agents are included in order to control the viscosity of the liquid composition to 500 to 800 cps and to control low temperature cloud clear properties. Usually, it is desirable to maintain clarity to a temperature in the range of 5° C. to 10° C. Therefore, the proportion of solubilizer generally will be from about 1% to 15%, preferably 2% to 12%, most preferably 3% to 8%, by weight of the detergent composition with the proportion of ethanol, when present, being 5% of weight or less in order to provide a composition having a flash point above about 46° C. Preferably the solubilizing ingredient will be a mixture of ethanol and either sodium xylene sulfonate or sodium cumene sulfonate or a mixture of said sulfonates or ethanol and urea. Inorganic salts such as sodium sulfate, magnesium sulfate, sodium chloride and sodium citrate can be added at concentrations of 0.5 to 4.0 wt. % to modify the cloud point of the nonionic surfactant and thereby control the haze of the resultant solution. Other ingredients which have been added to the compositions at concentrations of about 0.1 to 4.0 wt. percent are perfumes, sodium bisulfite, ETDA, isoethanoeic and proteins such as lexeine protein.

In addition to the previously mentioned essential and optional constituents of the gelled light duty detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; pearlescing agents and opacifiers; pH modifiers; etc. The proportion of such adjuvant materials, in total will normally be about 0.1 to 15% of weight of the detergent composition, and the percentages of most of such individual components will be a maximum of 5% by weight and preferably less than about 2% by weight. Sodium formate can be included in the formula as a preservative at a concentration of 0.1 to 4.0%. Sodium bisulfite can be used as a color stabilizer at a concentration of about 0.01 to 0.2 wt. %. Typical preservatives are dibromodicyano-butane, citric acid, benzylic alcohol and poly (hexamethylenebiguamide) hydro-chloride and mixtures thereof.

The instant composition can contain about 0.1 to 4.0% of a protein selected from the group consisting of hydrolyzed animal collagen protein obtained by an enzymatic hydrolysis, lexeine protein, vegetal protein and hydrolyzed wheat protein and mixtures thereof.

The present gelled light duty liquid detergents such as gelled dishwashing liquids are readily made by simple mixing methods from readily available components which, on storage, do not adversely affect the entire composition. However, it is preferred that the two surfactant be mixed with the water and then if present, the nonionic surfactant and/or zwitterionic surfactant are added then the hydrotrope and other minors are added with stirring and then sufficient alkali metal hydroxide is added to adjust the pH to about 5.5 to about 7.

The additives such as NaEDTA, formalin, perfume and colorant are added to the solution and the solution is stored at room temperature until de-aeration has occurred. An aqueous dispersion at a pH of about 2.0 of the hydroxypropyl cellulose polymer, wherein the concentration of polymer in the dispersion is about 10 wt. % to 25 wt. %, is added at 25° C. to the solution of surfactants to form the gelled detergent composition.

These products have unexpectedly desirable properties. For example, the foam quality and detersive property is equal to or better than standard light duty liquid detergents.

The following examples are merely illustrative of the invention and are not to be construed as limiting thereof.

DESCRIPTION OF THE PREFERRED EMBODIMENTS

EXAMPLE 1

The following formula was prepared at room temperature by simple liquid mixing procedures as previously described

| | A | B | C | D | E | F |
|---|---|---|---|---|---|---|
| $C_{10-13}$ Linear alkyl benzene sulfonate | 26.0 | 20.6 | 20.6 | 20.0 | 20.0 | 20.0 |
| $C_{12-14}$ AEOS 3EO sodium salt | 3.95 | 3.4 | 3.4 | 4.5 | 4.5 | 4.5 |
| Betaine surfactant | | | | | | |
| Sodium cumene sulfonate | 4.65 | | | 3.3 | 3.3 | 5.0 |
| Magnesium sulfate.$7H_2O$ | 7 | 7 | | 2.5 | 5 | 0.5 |
| NaEDTA | 0.12 | | | 0.135 | 0.135 | 1.35 |
| NaOH | 2.55 | | | 5.6 | 5.6 | |
| Formalin | 0.2 | 0.2 | 0.2 | 0.2 | 0.2 | 0.2 |
| Methocel J75MS-N | 1.7 | 2.5 | 2.5 | 2.5 | 2.5 | 6.7 |
| Monoethanol amide | | 0.5 | | 0.5 | 0.5 | 0.5 |
| Colorant | .004 | | | 0.004 | 0.004 | 0.004 |
| Perfume | 0.25 | | | 0.25 | 0.25 | 0.25 |
| Water | Balance | Balance | Balance | Balance | Balance | Balance |
| pH | 6.5 | 6.5 | 6.5 | 6.5 | 6.5 | 6.5 |
| Viscosity, 1000 Cps | 185 | 234 | 186 | 250 | 281 | 1000 |
| Melt temperature | >90° C. | >90° C. | >90° C. | >90° C. | >90° C. | >90° C. |

PROCESS

The preferred process for making this product involves three mixing operations. First, the surfactant solution (Part I) is made and stored which allows for natural deaeration. Second, the aqueous polymer dispersion is made in a separate vessel (Part II). Third, the surfactant solution and aqueous polymer dispersion are combined to form the finished product, which thickens to a gel over time. Parts I and II of this process can be made using typical batch mixers. An acceptable alternative process to making the product using an aqueous polymer dispersion is to add the polymer powder directly to the surfactant solution.

An alternative process to batch mixing would be to blend Parts I and II in a continuous in-line blending system. When a product is made batch-wise, as it thickens over time, it becomes more difficult to handle. Using a continuous blending system, during steady-state operations, a consistent product would be delivered at the exit of a static mixer The surfactant solution comes in contact with the aqueous polymer dispersion just before it is blended through the static mixer.

Below is a product summary grid comparing a commercial gel and the Methocel gel for key attributes:

GEL SUMMARY GRID

| Thickeneing/ Gel Ingredient | Commercial Urea Gel | Methocel Gel (Example 1-A) |
|---|---|---|
| Product Type | Thickened Liquid | Gel |
| Product Clarity | Somewhat Translucent | Crystal Clear |
| Product Memory/Flexibility | Poor - Little to none | Good |
| Viscosity (cps @ 25 C Helopath Spindle E 10 RPMs) | 4,000,000 | 220,000 |
| Firmness (perceived) | Soft | Firm |
| Melt Temperature | 45 C. | >90 C. |
| Making Equipment | High Heat/ Cooling tunnel | Liquids making/filling |

The differences in product clarity and appearance are dramatic. The urea gel is somewhat translucent while the Methocel gel is clear. The "memory" or "flexibility" of the product, defined as the ability of the product to maintain its original shape once perturbed, is different for the two gels. The shape changes for the urea gel when you press down on the product or remove a dollop. The Methocel gel will go back to its original shape. This is probably why the Methocel gel is perceived as firmer than the urea gel even though the urea gel is considerable thicker as measured by viscosity. The melt temperature for the urea gel is near the ambient temperatures of some tropical countries. The concern is that this product will become thin on hot days which is an undesirable characteristic. The Methocel gel is not affected by temperature once the product has gelled.

What is claimed is:

1. A gelled detergent composition consisting essentially of approximately by weight:

(a) 15% to 30% of an ammonium or an alkali metal salt of a sulfonate anionic surfactant;

(b) 1% to 6% of an alkali metal or an alkali earth metal salt of a $C_{8-18}$ ethoxylated alkyl ether sulfate, wherein the weight ratio of the sulfonate anionic surfactant to the ethoxylated alkyl ether sulfate is 25:1 to 3:1;

(c) 1 to 10% of a nonionic surfactant;

(d) 1 to 9% of a zwitterionic surfactant;

(e) 0.5 to 7% of an alkali metal hydroxide;

(f) a gelling system comprising 2.5% to 8% of a magnesium sulfate heptahydrate 1.5% to 5% of a hydroxy propyl methyl cellulose polymer;

(g) from about 1% to 6% by weight of a hydrotrope selected from the group consisting of a sodium salt of benzene sulfonate, xylene sulfonate and cumene sulfonate; (h) about 0.1 to 4% by weight of a sequestering agent; (i) a preservative amount of formalin; and (j) the balance being water, wherein the gelled composition has a Brookfield viscosity, 10 rpms, spindle E, at 25° C. of about 100,000 to about 1,000,000 cps.

2. A gelled detergent composition according to claim 1 wherein said actinic surfactant is selected from the group consisting $C_{8-16}$ linear alkyl benzene sulfonates, $C_{10-20}$ paraffin sulfonate and $C_{10-24}$ alpha olefin sulfonate and mixtures thereof.

3. A gelled detergent composition according to claim 1, wherein said composition contains about 1 wt. % to about 10 wt. % of said nonionic surfactant.

* * * * *